United States Patent [19]

Boome et al.

[11] Patent Number: 4,582,298

[45] Date of Patent: Apr. 15, 1986

[54] VARIABLE RADIUS CRANK WINCH

[75] Inventors: Christopher E. Boome, Woodside; William C. Ottemann, San Carlos, both of Calif.

[73] Assignee: Barient, Inc., Menlo Park, Calif.

[21] Appl. No.: 586,113

[22] Filed: Mar. 5, 1984

[51] Int. Cl.[4] ..... B66D 1/00

[52] U.S. Cl. ..... 254/266; 74/546

[58] Field of Search ..... 74/546, 525; 254/371, 254/344, 266; 242/84.1 J

[56] References Cited

U.S. PATENT DOCUMENTS

| | | | |
|---|---|---|---|
| 588,403 | 8/1897 | Davison | 74/546 X |
| 2,649,281 | 8/1953 | Hastings | 254/344 |
| 3,606,193 | 9/1971 | Allred | 242/84.1 J |
| 3,942,762 | 3/1976 | Reymond | 254/344 |

FOREIGN PATENT DOCUMENTS

| | | | |
|---|---|---|---|
| 186431 | 12/1936 | Switzerland | 74/546 |

*Primary Examiner*—Stuart S. Levy
*Assistant Examiner*—Katherine Jaekel
*Attorney, Agent, or Firm*—Limbach, Limbach & Sutton

[57] ABSTRACT

A pedestal winch with variable radius crank arms. The winch is intended for use on a sail boat or the like. The crank arms each include two telescoping sections together with a locking apparatus for locking the sections together in differing positions so as to achieve differing radii. A thumb-actuated operating member is positioned adjacent each crank handle for controlling the locking apparatus. Accordingly, an operator need not remove his/her hands from the crank handles in order to switch the winch between a short radius position for high speed winching and a long radius position for high power winching.

4 Claims, 2 Drawing Figures

VARIABLE RADIUS CRANK WINCH

BACKGROUND OF INVENTION

Large racing sail boats are generally equipped with pedestal driven winches containing one or more pedestal input sections and one or more winch drum output sections. The winch drum section contains a drum around which a sheet to be pulled is wound and a drive train, usually multispeed, for turning the drum. The pedestal section contains a support frame, a crank shaft rotatably mounted on the frame, crank arms and handles for rotating the crank, and a drive train connectable to the drive train of the winch drum section. The drive trains of the pedestal and drum sections are usually shifted in gear ratio by reversal of the direction of rotation of the pedestal crank shaft. Typically, two pedestal sections are provided with drive connections to drive either or both of two winch drum sections where the winch drum sections are used for pulling headsail sheets.

When the winch is used on a tack, for instance, the combined gear ratios of the pedestal and drum sections are usually started in the highest speed, lowest power, gear ratio, and the winch assembly is shifted through successively higher power, lower speed, gear ratios as the tension on the headsail sheet increases. After the winch is used for resetting a headsail in a tack, the winch is used to trim the sail by making fine adjustments in the position of the headsail sheet.

The crewman who performs the task of sail trimming is often different from the crewman who grinds the winch during tacking, and there are often different winch requirements for the grinder and the trimmer even where the two jobs are performed by the same crewman. Thus, the grinder's job is to pull in the headsail sheet as fast as possible, whereas the trimmer isn't as interested in speed as he is in ease and precision of operation. Additionally, the grinder often has the help of another grinder where two pedestal units are connected together to drive a single winch drum, and the trimmer usually works alone.

SUMMARY OF INVENTION

In accordance with this invention, we have provided a modified pedestal winch which can be adjusted quickly and easily to adapt the winch to the different requirements of the grinders and trimmers. We provide this adaptablility without impairing the regular functions of the winch so that this new feature is available without changing the operating characteristics of the winch with which the crewmen are familiar.

The new winch of our invention has variable radius crank arms while the remaining structure and operation of the winch remains the same. While the crank arms might be provided with infinitely variable lengths, we prefer to construct the arms so that they can be shifted between only ttwo positions, a short-arm position for grinders, and a long-arm position for trimmers. With this single shift capability, there is little to go wrong during the hectic moments of winch use.

Our variable radius crank arm winch can be constructed in the same way as pedestal winches have been made in the past using a short-arm radius the same as the crank arm radius used in the past. With the arms set in the short-arm position, the grinder can use the winch as he is accustomed. After use of the winch for tacking, the trimmer can extend the crank arms to the long-arm position to provide higher power, higher precision operation. This long-arm condition of the pedestal provides the condition the trimmer needs whereas the long-arm condition of the crank arms would have been a detriment for the grinders during high speed operation at the beginning of a tack.

The variable radius winch handles of our invention are locked in their different length conditions so that they do not change in length unintentionally during the rapid operation of the grinders. On the other hand, the variable radius handles of our invention are provided with quick release locks, operable by the user's thumb in the normal winch operating position. In this way the winch handles can be shifted rapidly during operation which provides the grinders with an extra highest power gear ratio in reserve which the grinders did not have before.

These and other features of the invention will be apparent from the following description of our preferred embodiment of our invention, it being understood that the variable radius crank arm winch of our invention can be constructed in many different ways.

BRIEF DESCRIPTION OF THE FIGURES

In the attached drawings.

DETAILED DESCRIPTION OF PREFERRED FORM

Figure 1:
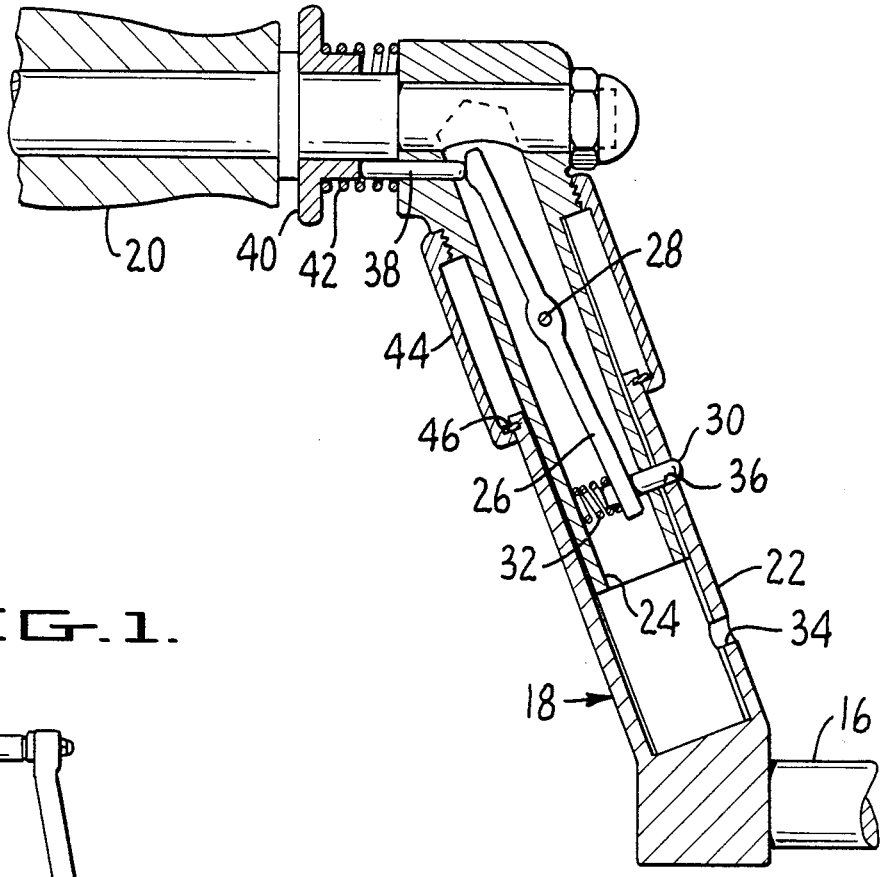
FIG. 1 is a side elevational view of a conventional pedestal winch which can be modified with variable radius crank arms in accordance with our invention.

The winch includes a base 10 supporting a winch drum section 12 such as a Barient Mark XX, three speed winch drum assembly. A pedestal frame section 14 is mounted on the base provided with a crank shaft 16, crank arms 18, and handles 20. The pedestal and drum sections contain conventional drive trains as described above.

Figure 2:
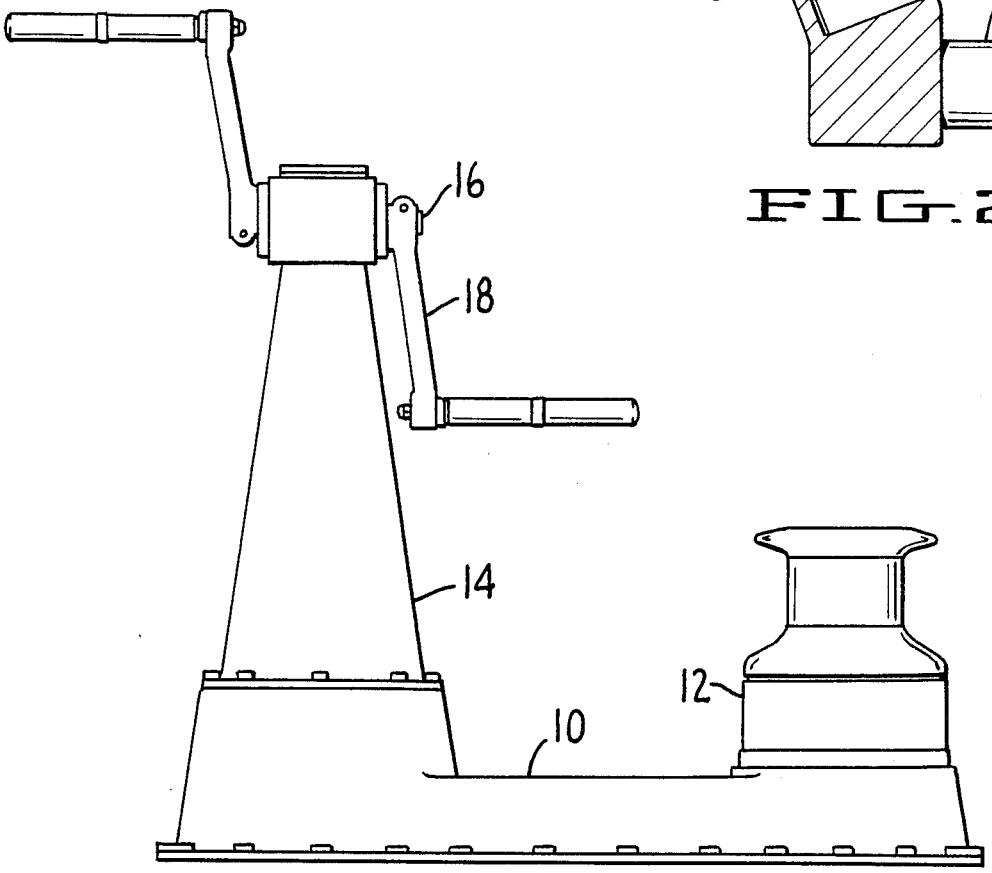
FIG. 2 is a fragmentary view of a handle portion of the winch of FIG. 1 modified in accordance with our invention.

As illustrated in FIG. 2, the crank arms 18 are made of outer and inner sections 22 and 24, respectively, splined together for telescopic, non-rotary motion. A toggle 26 is mounted on a pivot pin 28 in the inner arm section 24 and carries a locking pin 30 operated by a spring 32 to lock into either an inner hole 34 or an outer hole 36 to lock the handle into its short-arm or long-arm positions respectively. The upper end of the toggle is operated by a pin 38 which is in turn operated by a control ring 40 on the handle where it can be operated by the user's thumb. A spring 42 urges the ring to its inactive position.

A spline cover 44 is attached to the base of the handle by screw threads, and a snap-ring on the lower handle section 22 engages a lip on the lower end of the spline cover to limit extension of the variable radius arm. The lower end of the inner arm section is preferably spaced from the bottom of the inside of the lower handle section 22 as illustrated in FIG. 2 by the distance between the locking holes 34 and 36 to provide a retraction limit like the extension limit. Obviously, the handles on both sides of the crank shaft have variable radius crank arms as illustrated in FIG. 2.

We claim:

1. A pedestal winch comprising:

a winch drum adapted to receive a sheet to be pulled;

a crankshaft;

a pedestal supporting said crankshaft;

drive means for rotating said winch drum in response to rotation of said crankshaft;

a pair of handles to be gripped by an operator;

a crank arm connecting each crank handle to said crank shaft in a position generally parallel with said crankshaft;

each of each said crank arms including first and second elongate arm sections movably connected together for extension and retraction;

locking means for locking said arm sections in at least a short-arm position and in a long-arm position; and operating means for each crank arm including a control ring positioned coaxially with each of said crank handles and movable axially of the associated crank handle in response to manual actuation by an operator manually gripping said associated crank handle for releasing said locking means for permitting the associated crank arm to be switched between said short-arm and said long-arm position.

2. The winch of claim 1 wherein said arm sections are non-rotatable telescoping tubular members and said operating means includes an elongated member pivotally-mounted within one of said arm sections and having a first end which engages the other of said arm sections.

3. The winch of claim 2 wherein said operating means includes actuator means providing engagement between said ring and the second end of said elongate member for moving said elongate member to disengage the first end of said elongate member from said other arm section.

4. The winch of claim 2 wherein said other arm section has at least two spaced-apart openings for receiving said first ends of said elongate member with said arm sections being locked in said short-arm position when said first end of said elongate member is positioned in a first of said arm section openings and locking in said long-arm position when positioned in a second of said arm section openings.

* * * * *